United States Patent [19]

Stump

[11] 4,232,541

[45] Nov. 11, 1980

[54] DRAWING TECHNIQUE

[75] Inventor: Paul E. Stump, Beaver Falls, Pa.

[73] Assignee: The Babcock & Wilcox Company, New Orleans, La.

[21] Appl. No.: 6,065

[22] Filed: Jan. 23, 1979

Related U.S. Application Data

[62] Division of Ser. No. 879,288, Feb. 21, 1978, Pat. No. 4,148,207.

[51] Int. Cl.[3] ..... B21C 3/06

[52] U.S. Cl. ..... 72/283; 72/467

[58] Field of Search ..... 72/274, 283, 467

[56] References Cited

U.S. PATENT DOCUMENTS

| | | | |
|---|---|---|---|
| 2,843,862 | 7/1958 | Smith | 72/467 |
| 3,513,682 | 5/1970 | Rowell | 72/283 |
| 3,605,476 | 9/1971 | Hinshaw | 72/274 |
| 3,744,290 | 7/1973 | Sirois | 72/283 |

*Primary Examiner*—Milton S. Mehr

*Attorney, Agent, or Firm*—Robert J. Edwards; Robert H. Kelly

[57] ABSTRACT

A method and apparatus for improving the interior or exterior surface smoothness of a tube shell during cold draw operations is disclosed wherein the final reduction of the tube shell is completed within the die land.

2 Claims, 3 Drawing Figures

DRAWING TECHNIQUE

This is a division of application Ser. No. 879,288, filed Feb. 21, 1978, now U.S. Pat. No. 4,148,207.

BACKGROUND OF THE INVENTION

The invention relates to a method of manufacturing tubing and, more particularly, to an improved method and apparatus for increasing the inside or outside smoothness of cold drawn tubing that is drawn through a fixed die with an internal stationary mandrel plug disposed therewithin.

The cold drawing of tubes often involves the drawing of hot rolled tubular shells through a fixed die. The diameter and wall thickness of the tube shell are typically larger than the same dimensions of the finished tube. Simultaneous wall and diameter reductions may be achieved, moreover, by drawing the tube shell through a die opening, into which a cylindrical mandrel plug, fixed to a mandrel rod which holds it in a pre-set position, is inserted. The die opening, typically smaller than the outside diameter of the tube shell which is to be cold drawn, is generally provided with a bell shaped or conical shaped entrance or approach zone leading to a circular die land or bearing section. An annulus forms between the mandrel plug and the die opening. As the tube shell passes through the annulus its internal surface contacts a working surface on the mandrel plug and its external surface contacts the working surface of the die.

The outer diameter of the tube shell will be reduced to the diameter of the die land as it passes through the conical approach zone. The inner diameter of the tube shell is reduced simultaneously with its outer diameter, with little or no reduction of the wall thickness, until the inner surface of the tube shell contacts the cylindrical surface of the internally disposed mandrel within the conical approach zone. Thereafter, the inner diameter of the tube shell is essentially constant but the thickness of the wall decreases along with the outer diameter until entry into the die land. There is no further wall reduction after the shell enters into the die land. Excess metal due to the reduction in cross-section causes the length of the tube to increase. The cross section of the tube passing from the die opening is approximately equal to the cross section of the annulus within the die land.

The quality of the tube shell has considerable bearing upon the quality of the finished tube. It is essential, therefore, that the surfaces of the shell be free of defects such as seams and slivers to preclude the development of surface imperfections, pitting and unacceptable surface roughness in the drawn tube, particularly in tubular applications such as for hydraulic cylinders. Tube shells having defects may be properly conditioned by means of local or complete grinding of the surfaces of the shell. This necessitates additional labor intensive steps such as boring the inside surface of the shell or turning down the outside surface and results in the need to compensate for metal removed during boring or turning operations, or both.

SUMMARY OF THE INVENTION

An improved method and apparatus of cold drawing a tube shell to be worked so as to increase the exterior or interior smoothness of the drawn tube is presented.

A tube shell is positioned within a die opening having, in one embodiment, an approach zone and a cylindrical die land. The interior of the tube shell is contacted within the die opening with a mandrel having a first cylindrical working section angularly joined, in a preferred embodiment by a frusto-conical section, to a second smaller cylindrical working section. The mandrel is fixed in position within the tube shell and within the die with the first cylindrical working section adjacent to the exit side of the die opening. The tube shell is axially drawn through the die opening to reduce its inner and outer diameters and thickness. A final reduction in thickness is completed within the die land portion of the die opening.

In an alternative embodiment of the invention, the tube shell to be worked is positioned within a die opening with a cylindrical mandrel working surface fixed within the tube shell within the die opening. The die opening includes an approach zone and a die land including a first cylindrical section attached to a second smaller diameter cylindrical section by a tapered section. The second smaller diameter section is formed toward the exit side of the die opening. The tube shell is axially drawn contacting the interior of the tube shell with the mandrel plug and the exterior with the surface of the die opening so that at least part of the thickness of the shell is reduced within the die land.

The various features of novelty which characterize the invention are pointed out with particularity in the claims annexed to and forming a part of this specification. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWINGS

In the accompanying drawings, forming a part of this specification, and in which reference numerals shown in the drawings designate like or corresponding parts throughout the same.

DESCRIPTION OF THE PREFERRED EMBODIMENTS

Figure 1:
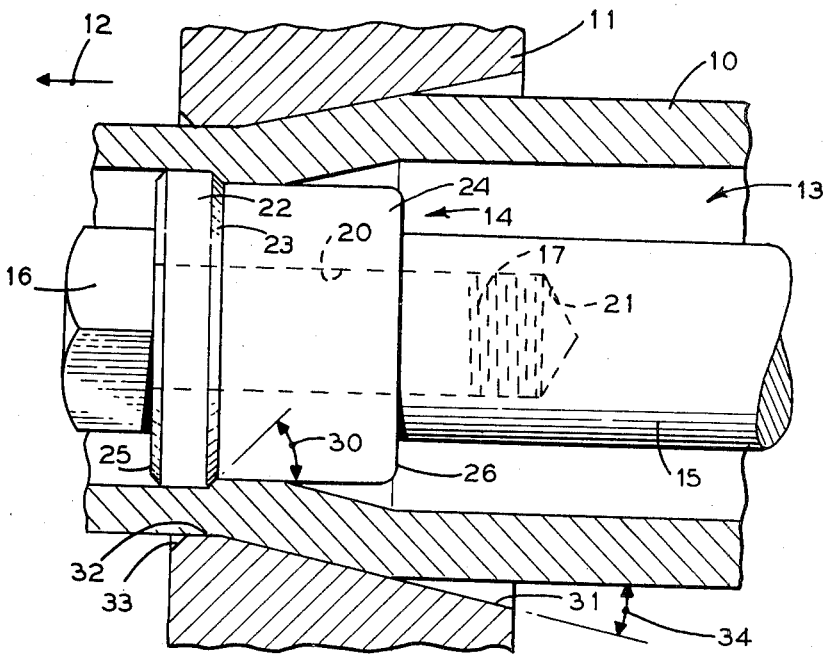
FIG. 1 is a side view, partly in section, of a tube shell, die and mandrel construction in accordance with the invention.

FIG. 1 illustrates a tube shell 10 being axially drawn through a fixed die 11 in the direction of arrow 12 by well known means (not shown) such as a draw carriage. A stationary mandrel 13 is disposed within the tube shell 10.

The mandrel 13 has a mandrel plug 14, constructed in accordance with the principles of the invention, fastened to a mandrel rod 15 by a retaining bolt 16 having a threaded end 17 that passes through a central longitudinal bore 20 in the plug 14 and threadably engages a threaded recess 21 in the end of the mandrel rod 15. The mandrel plug 14 of the preferred embodiment has stepped working surfaces including a larger diameter cylindrical working section 22 angularly joined to a smaller diameter cylindrical working section 24 by a frusto-conical section 23. The section 23 has an angle 30 of inclination with respect to the longitudinal axis of the plug. The leading end 25 of the plug 14 is on the larger working section 22 and is beveled in the preferred embodiment, as is known in the art, to facilitate positioning of the plug 14 within the tube shell 10. The trailing end 26 of the plug 14 is on the smaller diameter working section and abuts the mandrel rod. In the preferred embodiment, each section 22, 23, 24 of the plug 14 has a common central longitudinal axis.

The die 11 is provided with a die opening which includes a conical approach zone 31, a cylindrical die land 32, and a countersunk exit or relief zone 33 at the exit side of the die opening and, as represented in FIG. 1, is conventional. The conical approach zone has a half-angle 34 relative to the axis of the die opening. The longitudinal axis of the tube shell 10 is parallel, and preferably coaxial, with the axis of the die opening.

In operation, the tube shell 10 is positioned within the die opening and the mandrel plug 14 is held fixed in position within the die and the tube shell 10.

Figure 2:
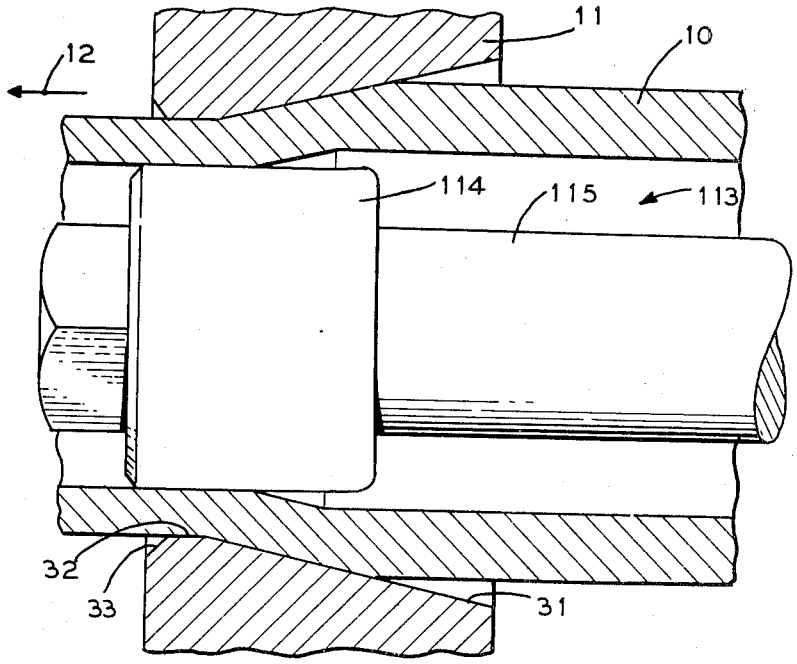
FIG. 2 (PRIOR ART)
FIG. 2 is a side view, partly in section, of a conventional tube shell, die and mandrel arrangement.

As shown, the exterior surface of the tube shell contacts the surface of the die opening, and the interior surface of the shell contacts the mandrel plug. The tube shell 10 is axially drawn through the die opening by conventional means in the direction of arrow 12 to cold work the shell. FIG. 2 is representative of a similar cold working operation using a conventional mandrel 113 including a cylindrical mandrel plug 114 fastened to a mandrel rod 115, and fixed within the die 11. As illustrated in both FIGS. 1 and 2, diametrical (inner and outer) reduction of the tube shell 10 commences as the tube shell 10 comes into contact with the surface of the conical approach zone 31. Reduction of the outer diameter continues as the tube shell 10 passes through the conical approach zone 31, but reduction of the inner diameter ceases, and reduction of the wall thickness is initiated, when the inner surface of the shell contacts the mandrel plug—in the case of the inventive plug, at the smaller diameter working surface (24) (see FIG. 1). In the prior art, as illustrated in FIG. 2, the inner diameter of the the moving tube shell 10 remains essentially unchanged after contacting the plug 114. As best shown in FIG. 1, however, the tube shell 10, in accordance with the invention, is reduced to its final inner diameter and wall thickness dimensions within the cylindrical die land 32 upon traversing the frusto-conical section 23 and contacting the larger diameter working section 22.

It has been found that the smoothness of the inner surface of a tube cold drawn with a stepped mandrel, as described, is improved. As the tube shell 10 passes over the frusto-conical section, the inner diameter is expanded forcing the tube material radially outward. The combination of selective metal working at the inner surface and radial compression work to produce an improved smoothing on the inner surface. Thus, any surface roughness on the inner surface of an ingoing tube shell, such as would normally be present in a hot finished seamless tube, would be greatly diminished, if not completely eliminated. In contrast, appreciable roughness would remain on the inner surface of a hot finished tube drawn with a convention mandrel plug having a constant diameter cylindrical plug.

The following example exemplifies, the details of a tube drawn with a mandrel constructed in accordance with the invention:

EXAMPLE I

Figure 3:
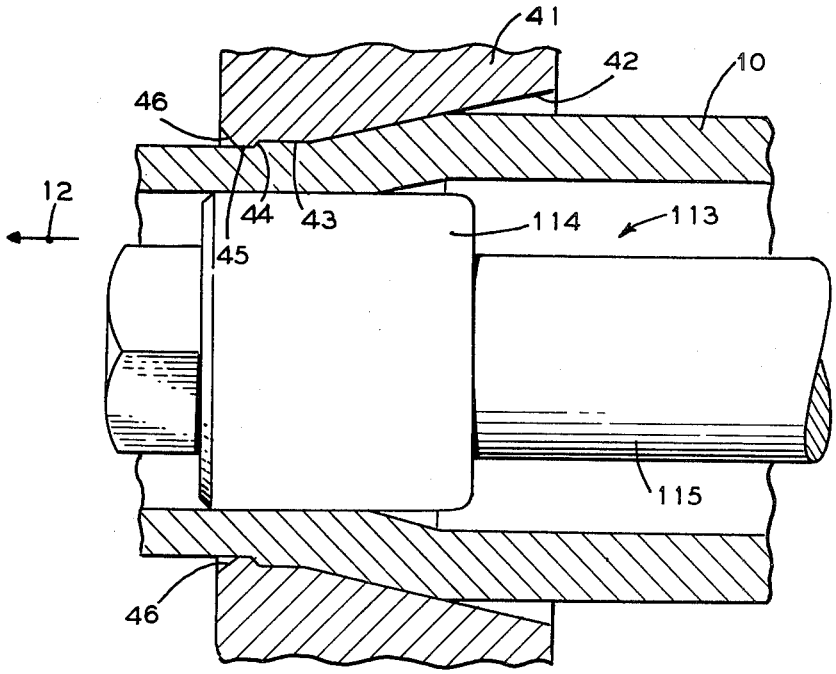
FIG. 3 is a side view, partly in section, of a tube shell, die and mandrel construction in accordance with an alternative embodiment of the invention.

A steel tube shell having an outside diameter of 5.500 inches and a wall thickness of 0.600 inches was cold drawn to a tube having an outer diameter of 5.000 inches and a wall thickness of 0.512 inches. The initial surface roughness of the inner surface of the tube shell ranged from 250 to 300 RMS microinches. The resulting inside surface roughness ranged between 20 and 30 RMS microinches. The surface resulting with the use of a conventional cylindrical mandrel to produce the same finished tube size would have been approximately 100 RMS microinches. The mandrel plug utilized has the following dimensions:

Section (22) Diameter: 3.976 inches
Section (24) Diameter: 3.956 inches
Angle (30): 45 degrees Improved outside smoothing of a tube shell can be achieved, in accordance with the invention, by utilizing a die 41 as shown in FIG. 3. The die 41 has a die opening including a conical approach zone 42, a die land with a larger cylindrical working section 43 connected to a smaller cylindrical working section 45 by a tapered section 44, and a countersunk exit zone 46. The smaller cylindrical working section is disposed adjacent to the exit side of the die opening. A conventional mandrel 113 having a cylindrical mandrel plug 114 is disposed within the die 41, and the tube shell is shown being axially drawn in the direction of arrow 12 by well known means (not shown).

In operation, the mandrel plug 114 is held fixed in position within the die 41 and the tube shell 10. The tube shell 10 is positioned within the die opening such that its inner diametrical surface contacts the cylindrical surface of the mandrel plug 114. The tube shell is drawn axially so that the exterior surface of the tube shell contacts, in order, at least part of the surface of the approach zone 42, the larger cylindrical working section 43, the tapered section 44, and the second cylindrical working section 45.

It will be understood that it is possible to draw a tube shell with both a die and mandrel constructed in accordance with the invention as heretofore described.

Smoother surfaces may be achieved, moreover, for a given wall reduction by subjecting the tube shell to multiple draw passes in order to incrementally reach the ultimately desired wall reduction.

As used in the specification and claims, the term "working section" shall be understood as capable of imparting cold work to a tube being drawn in contact with a surface portion of the working section.

I claim:

1. An improved method of cold drawing a tube shell to be worked through an apparatus having a die with generally constant diameter cylindrical mandrel plug means fixed within the tube shell and within the die opening for improving outside smoothness of said tube shell which comprises: positioning the tube shell within a die opening having an approach zone, a die land including a first cylindrical section, a second smaller diameter cylindrical section, a tapered section connecting the first section to the second section, and a countersunk exit section, the second smaller diameter cylindrical section being adjacent to the exit section of the die opening; contacting the interior of the tube shell with the mandrel plug when said contacting surface is adjacent said approach zone to prevent reduction of the inside diameter of said tube shell; contacting the exterior of the tube shell with the surface of the die opening; and axially drawing the tube shell so that the exterior surface contacts in order at least part of the surface of the approach zone to first reduce the outside diameter of said tube shell, the first cylindrical section, the tapered section, and the second cylindrical section to produce a heavy and rapid wall reduction in said tube shell.

2. In an apparatus for cold drawing tubes having a die opening, means for axially drawing a tube shell to be worked through the die opening, an internal cylindrical mandrel plug with a flat annular surface extending the length of said mandrel, and means for internally fixing the mandrel plug within the tube shell and the die opening, the improvement which comprises forming a die land with a conical approach zone, a first larger cylindrical section, a second smaller cylindrical section, a tapered section connecting the first section to the second section, and a countersunk exit section the second section being adjacent to the exit section, to produce a heavy and rapid wall reduction in said tube shell.

* * * * *